US006687920B2

(12) United States Patent
Berns

(10) Patent No.: US 6,687,920 B2
(45) Date of Patent: Feb. 10, 2004

(54) SPINAL AND BACK PROTECTION SYSTEM

(75) Inventor: Jason Berns, Boulder, CO (US)

(73) Assignee: Salomon, S.A. (FR)

( * ) Notice: Subject to any disclaimer, the term of this patent is extended or adjusted under 35 U.S.C. 154(b) by 229 days.

(21) Appl. No.: 09/948,191

(22) Filed: Sep. 7, 2001

(65) Prior Publication Data

US 2003/0050581 A1 Mar. 13, 2003

(51) Int. Cl.[7] ..... A41D 13/00
(52) U.S. Cl. ..... 2/467; 2/92; 602/20
(58) Field of Search ..... 2/467, 455, 44, 2/92, 267, 69, 114, 115, 93, 102, 108; 602/19, 20; 128/874, 870, 846, 873, 869, 99.1, 100.1

(56) References Cited

U.S. PATENT DOCUMENTS

| | | | | |
|---|---|---|---|---|
| 5,140,995 A | | 8/1992 | Uhl | |
| 5,328,447 A | | 7/1994 | Kapounek et al. | |
| 5,381,558 A | * | 1/1995 | Lo | 2/115 |
| 5,400,801 A | * | 3/1995 | Archer, III | 128/846 |
| 5,477,558 A | * | 12/1995 | Volker et al. | 2/461 |
| 5,571,076 A | * | 11/1996 | Cooper | 602/19 |
| 5,768,717 A | | 6/1998 | Le Sueur | |
| 6,519,781 B1 | * | 2/2003 | Berns | 2/267 |

FOREIGN PATENT DOCUMENTS

| | | |
|---|---|---|
| DE | 29819408 U1 | 1/1999 |
| EP | 1 082 917 A2 | 3/2001 |
| WO | WO 99/00030 A1 | 1/1999 |
| WO | WO 99/04661 A1 | 2/1999 |
| WO | WO 00/74510 A1 | 12/2000 |

* cited by examiner

*Primary Examiner*—Tejash Patel
(74) *Attorney, Agent, or Firm*—Patton Boggs LLP

(57) ABSTRACT

A spinal protection system having a pad of energy-absorbing material with wings extending outward from a longitudinal axis. There are gaps between adjacent wings to allow flexing of the pad. Score lines cut between the wings allow the pad to twist and flex to conform to movement.

53 Claims, 3 Drawing Sheets

SPINAL AND BACK PROTECTION SYSTEM

FIELD OF THE INVENTION

This invention relates to protective padding to absorb impacts. More particularly, this invention relates to a system for protecting a spine of a user. Still more particularly, this invention relates to a spinal protection system that is flexible to allow a user to move with minimal restriction and is breathable to allow perspiration to escape from the body of a user.

STATEMENT OF THE PROBLEM

Many sports and occupations require safety equipment such as padding that protects the users from impacts that occur. Some examples of sports where padding is needed include but are not limited to bicycling, football, hockey, in-line skating, skiing and snowboarding. An example of an occupation that requires safety equipment is construction. Designers of such safety equipment face a number of obstacles.

One particular area of concern for designers of safety equipment is the spine. A spinal protector must provide acceptable protection for the spine. The spinal protector should also be flexible to allow a user to flex and bend in a natural manner with minimal impedance. A spinal protector should also be lightweight in order to not overburden the user. Furthermore, a spinal protector should also be breathable to allow perspiration and heat to escape from the body of the user. Although there are a number of spinal protection systems in the art, heretofore prior art spinal protectors do not adequately satisfy these requirements.

One type of prior art spinal protector is described in WO Document 99/0030. This spinal protector is made by thermoforming a fabric in the shape of a spine and injecting foam into a pocket formed in the fabric. This system does not have the desired flexibility, and the thermoformed material does not allow perspiration to adequately escape.

A second type of prior art spinal protector is described in U.S. Pat. No. 5,328,447 issued Jul. 12, 1994 to Kapounek et al. This spinal protection device is made of rigid interlocking plates with a padding of energy-absorbing material underneath the plates. The rigid plates hinder movement and prevent perspiration from escaping.

A third type of prior art spinal protector is described in U.S. Pat. No. 5,768,717 issued Jun. 23, 1998 to Le Sueur. This spinal protector is made of segments that are designed to be placed in a stepped manner over the spinal column. The steps allow the segments to slidably cooperate with one another to allow flexing of the spine. The segments are filled with a fluid material that will absorb the force of impacts. One problem with this design is that the segments must be made of material that can contain the fluid. Therefore, this design is not breathable. A second problem is that the flexibility provided by the stepped segments is inadequate and hinders movement of the user.

Therefore, there is a need in the art for a spinal protector that provides sufficient protection of the spine, flexibility to allow movement, and is breathable to allow perspiration to escape.

STATEMENT OF THE SOLUTION

The above and other problems are solved and an advance in the art is made by a spinal protection system of this invention. This spinal protection system is flexible in that the system allows a user to bend with minimal hindrance. The protection system in accordance with this invention also braces the back to prevent the spine from being bent over backwards in an undesirable direction. A spinal protection system in accordance with this invention also allows perspiration to escape. Therefore, this spinal protection system may be included into a garment.

In accordance with this invention, a spinal protection system is configured in the following manner. The spinal protection system has a pad of flexible, energy-absorbing material that receives and dissipates energy of an impact. The pad has an inner side that is proximate a back of a user, an outer side opposite said inner side, a first side perpendicular to a longitudinal axis and a second side perpendicular to the longitudinal axis. The longitudinal axis is substantially parallel to a spine of a user.

Pairs of wings are cut into the pad on opposing sides of the longitudinal axis. The wings on the same side of the pad are separated by gaps between the wings to provide space for movement. Score lines are cut into the pad along the longitudinal axis between mated pairs of wings to facilitate movement of the pad with movement of a spine of a user. In a preferred embodiment, the score lines are substantially circular. The circular score lines are sized to have a diameter such that the score lines intersect junctions of adjoining wings on each side of the pad.

In a preferred embodiment, the energy absorbing material is a bi-density foam with a first layer of low-density foam and a second layer of high-density foam. The low-density foam on the first layer is on the inner side of the pad. The high-density foam is on the outer side of the pad. In the preferred embodiment, the score lines are cut through the second layer of high-density foam. Also, the pad may be formed to have an s-shaped curvature in a preferred embodiment to conform to the shape of a human spine.

In a preferred embodiment, the wings have opposing sides slanted inwards towards each other from an end of each wing proximate the longitudinal axis to an end distal the longitudinal axis. Slanting of the sides of the wings allows enough space in the gaps between the wings to allow adjacent wings to flex back and forth with respect to each other.

The spinal protection system may also have a rigid spine affixed to an outer side of the pad along the longitudinal axis. In one embodiment, the spine is a narrow piece of rigid material. The rigid spine may have cuts through the spine that are mated to the score lines in the pad. The spine may be made of a rigid material such as high-density foam or plastic.

The spinal protection system of this invention may also include a spine reinforcement member made of rigid material that affixes to the rigid spine or a top side of the pad along the longitudinal axis. The spine reinforcement member connects to the spine or pad in the following manner in a preferred embodiment. There is a groove cut along the longitudinal axis in a top side of the spine. Along the groove, the opposing sidewalls have lips proximate the upper edge. An attachment member on a bottom side of the spine reinforcement member mates with and is inserted into the groove. The attachment member may be press fit into the groove in this embodiment.

In a preferred embodiment, the spine reinforcement member is made of multiple segments. Each segment is shaped to correspond to an underlying segment of the pad defined by the score lines. In the preferred embodiment, there are substantially circular segments that fit over circles along the longitudinal axis of the pad defined by the score lines. H-shaped segments having first and second sides with concave curvatures are formed to receive adjacent ones of the substantially circular segments and fit over segments of the pad between the circles defined by the score lines.

In a preferred embodiment, the pad may also have top and bottom members cut into the pad. The top and bottom members have ends that are cut to provide contours that allow flexibility in the neck and lumbar regions of the user.

In a preferred embodiment, the spinal protection system of this invention is inserted into a pocket of a garment on a dorsal side designed to receive the pad. The inner side of the pad is proximate an outer layer of the garment and the outer side is proximate the inner side of an outer layer of the pocket. The inner side of the pad may be to the inner side of the pocket or outer side of the garment. The pad may be removable from the pocket.

BRIEF DESCRIPTION OF THE DRAWINGS

The above and other features of this invention are described in the Detailed Description below and the following drawings.

DETAILED DESCRIPTION

Figure 1:
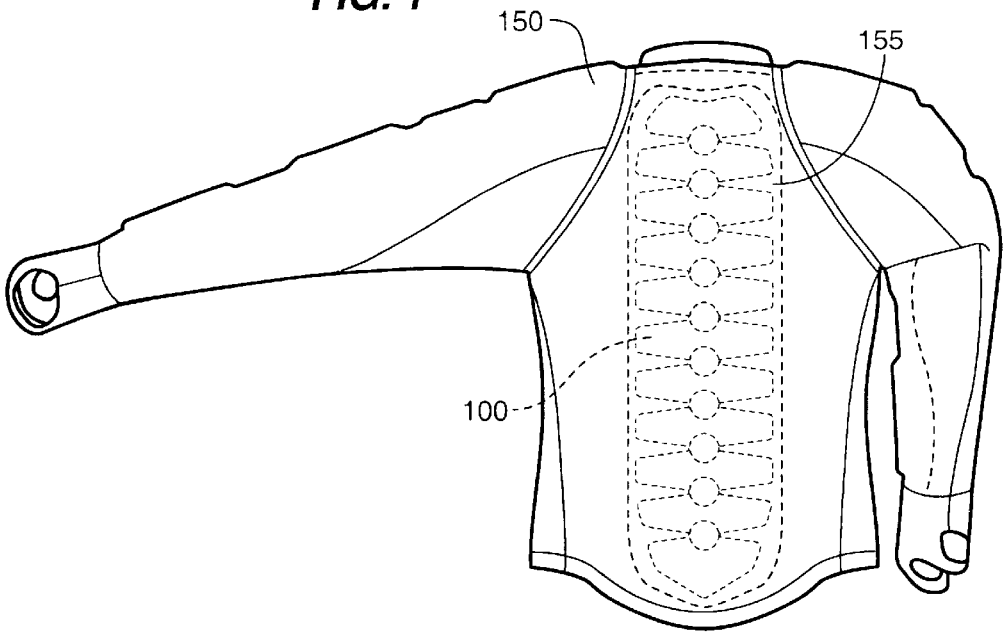
FIG. 1 illustrates a preferred embodiment of the spinal protection system inserted into a garment.

This invention relates to a spinal protection system. The spinal protection system of this invention absorbs energy from the force of an impact and dissipates the force. The spinal protection system of this invention also acts as a spinal brace preventing backward, unnatural bending of the spine. The spinal protection system of this invention is for use in garments for protection in sporting events and occupational wear. FIG. 1 illustrates a preferred embodiment of the spinal protection system 100 in accordance with this invention as inserted into a garment 150.

Figure 2:
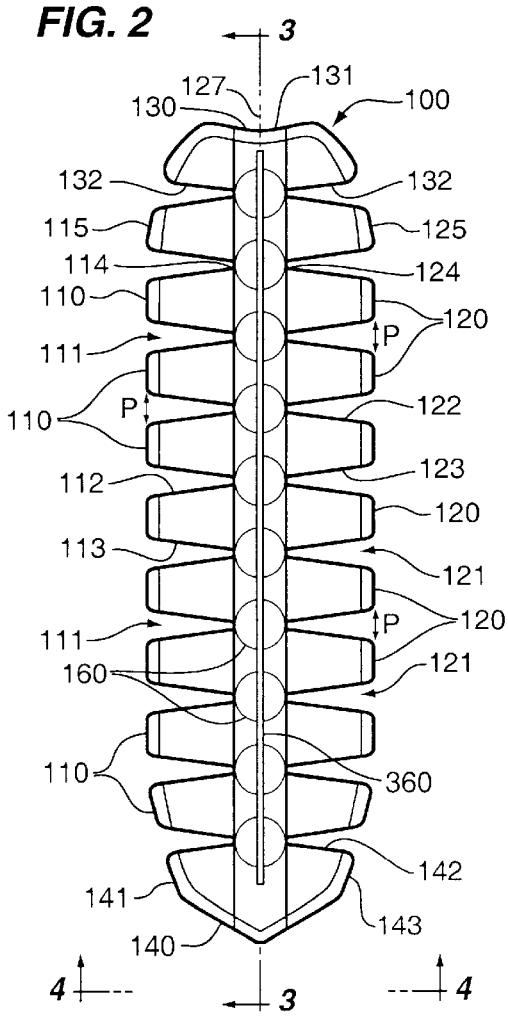
FIG. 2 illustrates a preferred embodiment of the spinal protection system of the invention withdrawn from the garment of FIG. 1.
Figure 3:
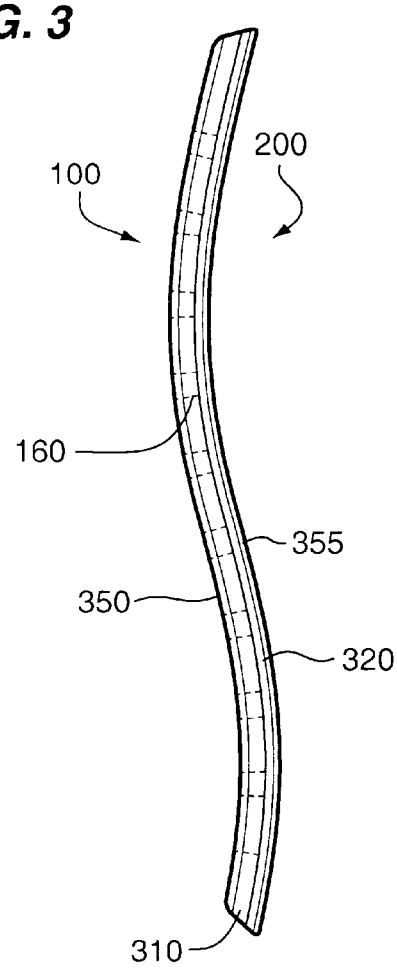
FIG. 3 illustrates a side view of the pad of FIG. 1.
Figure 4:
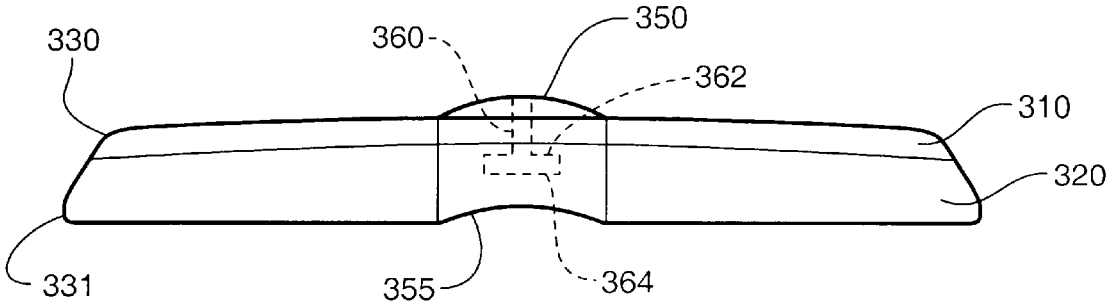
FIG. 4 illustrates an edge view of the pad of the spinal protection system of this invention.

FIG. 2 shows the spinal protection system removed from the garment. The spinal protection system of this invention includes a pad of energy absorbing material 100. The energy absorbing material may be a foam or other semi-rigid material. The foam may by single layered or multi-layered. In a preferred embodiment, the energy absorbing material is a bi-density foam. An example of such a foam is described in WO document No. 00/16652 by Brock which is incorporated by reference as if set forth herein. FIG. 4 illustrates an end on view of the pad showing a bi-density foam in accordance with a preferred embodiment. High-density foam 310 is on an outer side of pad 100 and low-density foam 320 is on a inner side of the pad. An additional layer of high-density foam may form a spinal ridge 350. The inner side of pad 100 is positioned proximate the spine of the user and the outer side faces the outside of a garment. As can also be seen from FIG. 4, all edges 330 and corners 331 of pad 100 are rounded to facilitate comfort and protection of a user in the case of an impact. Referring to FIG. 3, FIG. 3 is side view of pad 100 shown in FIG. 2. Pad 100 may be formed to have a substantially s-shaped curve 200 along a longitudinal axis to fit to the curvature of a spine of a user.

Referring back to FIG. 2, pad 100 has a longitudinal axis 127 along a centerline of pad 100. Longitudinal axis 127 is approximately parallel to a spine of a user. Wings 110 on a first side of pad 100 extend outward in a substantially perpendicular manner from longitudinal axis 127. Adjacent wings 110 are separated by gaps 111, which allow the wings to flex as a user bends either forward or laterally and/or twists. Wings 120 on a second side of pad 100 extend outwardly in a substantially perpendicular manner from longitudinal axis 127. Adjacent Wings 120 are separated from each other by gaps 121 to allow the wings to move either forwardly or laterally with the twisting or bending of a spine of a user. Each wing 120 is mated with one of wings 110 and extends outward in the opposite direction of the mated wing 110. Wings 110 and 120 are preferably formed by cutting gaps 111 and 121 into pad 100.

In a preferred embodiment, opposing sides 112, 113 of wings 110 and opposing sides 122, 123 of wings 120 are slanted inward toward each other from an end 114, 124 proximate longitudinal axis 127 to an end 115, 125 distal longitudinal axis 127. The slant of the sides of wings 110, 120 allows for greater distance between adjoining wings for greater flexibility to bend and twist with the spine of a user.

Score lines 160 are cut into pad 100 along longitudinal axis 127 between mated pairs of said wings 110, 120 to facilitate movement of pad 100 with movement of the spine of a user. Preferably, the score lines are substantially circular to facilitate movement in the direction indicated by arrow P. Furthermore, the circular score lines have a diameter such that the score lines intersect with an inner end of gaps 111 of adjoining wings on both sides of pad 100. This maximizes the bending and flexing in cooperation of one another of the adjoining wings. In a preferred embodiment, the score lines are cut through the high-density foam of an outer layer.

In a preferred embodiment, pad 100 has a top member 130 that is above wings 110, 120 on an upper end of pad 100. Top member 130 has contoured, rounded topside 131. Topside 131 is contoured and rounded to provide comfort when pad 100 may come into contact with the neck of a user and allows a user to roll the neck freely with minimal encumbrance. The bottom end 132 of top member 130 has a slant similar to the sides of wings 110, 120 to allow twisting and bending of the wings.

Bottom member 140 is below wings 110 on pad 100. Bottom member 140 has a bottom side 141 that is contoured to fit against a lumbar region of a user and facilitate movement of the hips of a user. In a preferred embodiment, topside 142 of bottom member 140 is cut to have slants that extend outward toward the bottom end from longitudinal axis 127 to an outer edge 143. This allows wings 110, 120 adjacent bottom member 140 to flex in relation to bottom member 140.

In a preferred embodiment, pad 100 fits into a pocket 155 formed in a dorsal side of a garment, such as jacket 150. The inner side of pad 100 may be affixed to the inside of pocket 150. Pad 100 may be affixed by gluing, laminating or sewing pad 100 to an inside of pocket 155. Pocket 155 may have an opening to allow a user to remove pad 100 or may be sealed to prevent access.

As shown in FIG. 4, the spinal protective system of this invention may include a spinal ridge 350. Spinal ridge 350 is a long narrow strip of essentially rigid material that is affixed to pad 100 on the outer side along longitudinal axis 127. Spine 350 may be affixed by gluing, laminating, sewing or any other method those skilled in the art desire. In a preferred embodiment, spinal ridge 350 is made of high-density foam. Spinal ridge 350 has score lines mated to the score lines 160 in pad 100. In a preferred embodiment, the score lines in spinal ridge 350 are cut completely through spine 350. The protective system 100 may also include a spinal curvature 355 (FIG. 4), which is a indented section along longitudinal axis 127 that prevents pressure from being placed directly on the spine. This dissipates the force applied to the spine or at least significantly lessens the force applied to the spine if an impact is particularly forceful.

Figure 5:
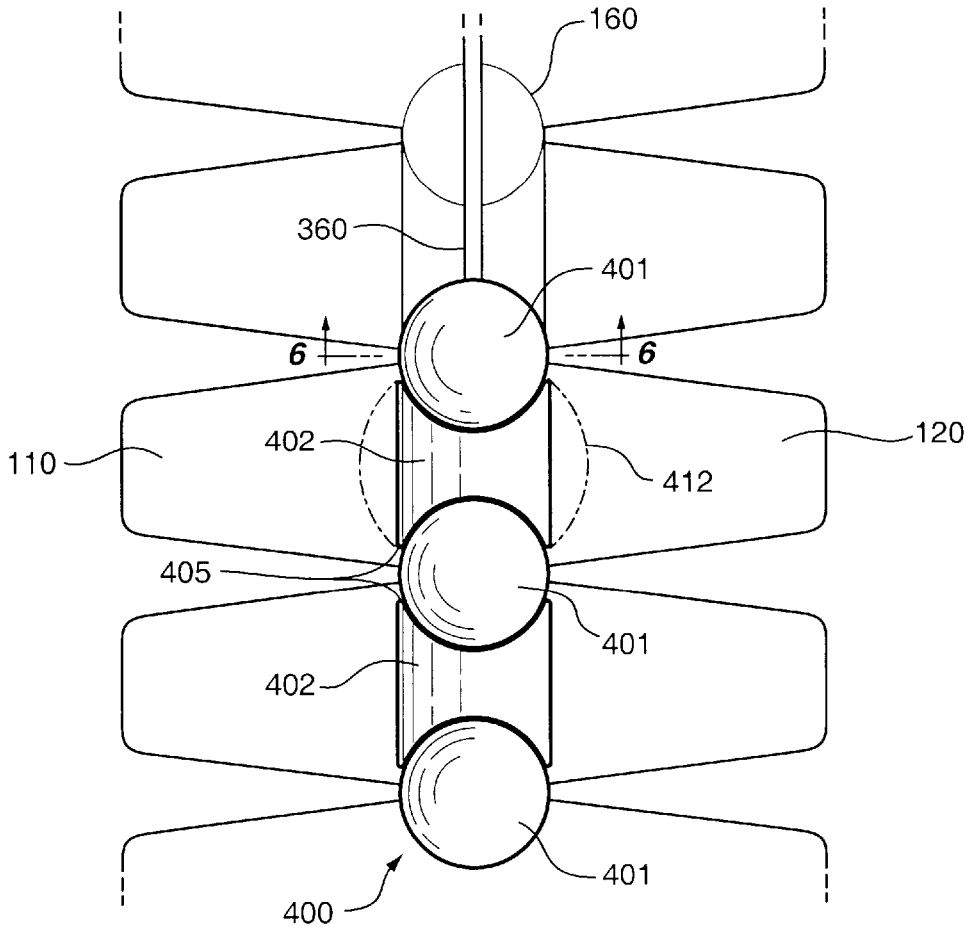
FIG. 5 illustrates a top side view of a spine reinforcement member of this invention.

FIG. 5 illustrates a spine reinforcement member 400 that may be added to the spinal protection member of this invention. Spine reinforcement member 400 is made of rigid material to help prevent bending backwards of the spine in an unnatural direction and to protect against sharp blows. Spine reinforcement member 400 may be affixed to an upper side of pad 100 along longitudinal axis 127 or spine 350. Spine reinforcement member may be affixed to pad 100 by gluing, sewing, or other manner. In the preferred embodiment, which will be discussed below, it is affixed by interlocking members. In a preferred embodiment, spine reinforcement member 400 is made of a rigid plastic, though it may be made of metal or other suitable material. Spine reinforcement member 400 has cuts 405 along the longitudinal axis that mate with score lines 460 in pad 100 to allow bending and twisting.

In a preferred embodiment, spine reinforcement member 400 is made of circular segments 401 and H-shaped segments 402. Circular segments 401 are substantially circular having a radius substantially equal to the radius of the circles in pad 100. H-shaped segments 402 have concave curvatures 405 on opposing sides mated to receive sides of circular segments 401. In this fashion, circular segments 401 and H-shaped segments 402 fit together and may move with flexing or twisting of pad 100. In an alternative embodiment, H-shaped sections 402 has accurate extensions 412 that extend out over wings 110 and 120 a short distance to provide added impact protection.

Figure 6:
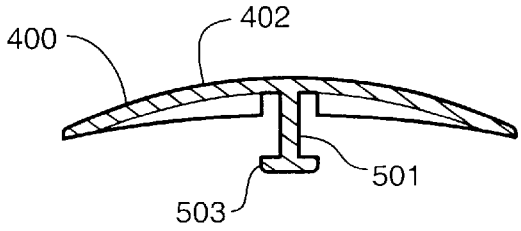
FIG. 6 illustrates an edge view of the spine reinforcement member in accordance with this invention.

Spine reinforcement member 400 may be affixed to a pad 100 that does not include spinal ridge 350 or may be affixed to a pad that does include such a spinal ridge. In a preferred embodiment, spine reinforcement member 400 is affixed to pad 100 or spinal ridge 350 in the following manner. An inverse T-shaped groove 360 (FIGS. 1 and 4) is formed in the topside of pad 100 or spine 350 along longitudinal axis 127. The groove has a pair of lips 362 substantially along the edges of the T cross-portion 364 on opposing sides of the groove. FIG. 6 is an end view of H-shaped spine reinforcement member 402. As shown in FIG. 6, spine reinforcement member 402 includes an interlocking-member 501 which is also T-shaped in cross-section. Interlocking member is a T-shaped protrusion 501 that extends along the longitudinal axis of spine reinforcement member 402. Interlocking member 501 is press fit into groove 360 along longitudinal axis 127 of pad 100 or spine 350 with the edges 503 of the T interlocking with the lips 362 of the cross-portion 364 of the groove 360. T-shaped member 351 may then be glued into the groove. Similarly, the circular segments 401 have a T-shaped protrusion having essentially the same shape as the protrusions on the H-shaped segments.

The above is a description of the preferred embodiments of a spinal protection system according to this invention. It is expected that those skilled in the art can, and likely will, design alternative spinal protection systems that will differ in some respects but will still infringe on this invention as set forth in the claims below either literally or through the Doctrine of Equivalents.

What is claimed is:

1. An energy absorbing protective device that protects a back comprising:

a pad of flexible energy absorbing material that receives and dissipates energy of an impact wherein said pad has an inner side that is proximate a back of said user, an outer side opposite said inner side, a first side perpendicular to a longitudinal axis and a second side perpendicular to said longitudinal axis;

a first plurality of wings on said first side of said pad that are substantially perpendicular to said longitudinal axis of said pad wherein said plurality of wings are separated by gaps between said first plurality of wings;

a second plurality of wings on said second side of said pad that are substantially perpendicular to said longitudinal axis wherein said second plurality of wings are separated from each other by gaps and each of said second plurality of wings are mated with one of said first plurality of wings on said first side of said pad; and a plurality of score lines in said pad along a longitudinal axis between mated pairs of said first and second pluralities of wings to facilitate movement of said pad with movement of a back of a user.

2. The energy absorbing protective device of claim 1 wherein said energy absorbing material comprises:

a first layer of low density foam; and a second layer of high density foam wherein said high density foam has a greater density than said low density foam.

3. The energy absorbing device of claim 2 wherein said first layer is on said inner side of said pad.

4. The energy absorbing device of claim 2 wherein said second layer is on said outer side of said pad.

5. The energy absorbing device of claim 4 wherein said plurality of score lines cut through said second layer of high density foam.

6. The energy absorbing device of claim 1 wherein said score lines are substantially circular cuts in said pad.

7. The energy absorbing device of claim 6 wherein said circular cuts have diameters that allow said circular cuts to intersect junctions between adjacent ones of said first and said second pluralities of wings.

8. The energy absorbing device of claim 1 further comprising:

a spinal ridge affixed to an outer side of said pad along said longitudinal axis.

9. The energy absorbing device of claim 8 further comprising:

a plurality of cuts through said spinal ridge that are mated to said plurality of score lines in said pad.

10. The energy absorbing device of claim 8 wherein said spinal ridge comprises a high density foam.

11. The energy absorbing device of claim 8 wherein said spinal ridge comprises plastic.

12. The energy absorbing device of claim 1 further comprising:

a spine reinforcement member made of rigid material that affixes to said pad along said longitudinal axis.

13. The energy absorbing device of claim 12 further comprising:

a groove cut in said outer side of said pad along said longitudinal axis;

a first lip along a first side wall of said groove;

a second lip along a second side wall of said groove; and an attachment member on a bottom side of said spine reinforcement member that mates with said groove wherein said attachment member is press fit into said groove.

14. The energy absorbing device of claim 12 wherein said spine reinforcement member comprises:

a plurality of segments wherein each of said plurality of segments is shaped to correspond to an underlying segment of said spine defined by said plurality of score lines.

15. The energy absorbing device of claim 14 wherein said plurality of segments comprises:

a first plurality of substantially circular segments; and a second plurality of segments having a first and a second sides having concave curvatures that are formed to receive adjacent ones of said first plurality of substantially circular members.

16. The energy absorbing device of claim 1 wherein said plurality of score lines comprises:

a plurality of circular cuts into said pad between mated pairs of said first and said second pluralities of wings.

17. The energy absorbing device of claim 1 wherein said each of said first and said second plurality of wings comprise:

a first end proximate a longitudinal axis and a second end distal said longitudinal axis; and a first side and a second side that start at said first end and are angled to slant toward one as the sides extend toward said distal end.

18. The energy absorbing device of claim 1 further comprising:

a pocket on a dorsal side of a garment for receiving said pad.

19. The energy absorbing device of claim 18 wherein said inner side of said pad is proximate an outer layer of said garment and said outer side is proximate inner side of an outer layer of said pocket.

20. The energy absorbing device of claim 19 wherein said inner side of said pad is affixed to said garment.

21. The energy absorbing device of claim 19 wherein said pad is removable from said pocket.

22. The energy absorbing device of claim 1 further comprising:

an S-shaped curvature of said pad to configure to a spine of a user.

23. The energy absorbing device of claim 1 further comprising:

a top member of said pad that has an upper contoured side.

24. The energy absorbing device of claim 23 wherein said upper contour side is formed to allow movement of the neck of said user.

25. The energy absorbing device of claim 23 further comprising:

bottom edges of said top member that are slanted outward from said longitudinal axis towards said top side.

26. The energy absorbing device of claim 1 further comprising:

a bottom member that has a bottom side contoured to form to the lumbar region of a user.

27. The energy absorbing device of claim 26 wherein said bottom side of said bottom member has a distal edge and extends outward and upward from said longitudinal axis to said edge.

28. A method for providing an energy absorbing protective device that protects a spine having a pad of flexible energy absorbing material that receives and dissipates energy of an impact wherein said pad has an inner side that is proximate a back of said user, an outer side opposite said inner side, a first side perpendicular to a longitudinal axis and a second side perpendicular to said longitudinal axis, said method comprising the steps of:

defining a first plurality of wings on said first side of said pad that are substantially perpendicular to said longitudinal axis of said pad wherein said plurality of wings are separated by gaps between said first plurality of wings;

defining a second plurality of wings on said second side of said pad that are substantially perpendicular to said longitudinal axis wherein said second plurality of wings are separated from each other by gaps and each of said second plurality of wings are mated with one of said first plurality of wings on said first side of said pad; and cutting a plurality of score lines in said pad along a longitudinal axis between mated pairs of said first and second pluralities of wings to facilitate movement of said pad with movement of the back of a user.

29. The method of claim 28 wherein said energy absorbing material comprises a first layer of low-density foam and a second layer of high-density foam wherein said high-density foam has a greater density than said low-density foam.

30. The method of claim 29 wherein said first layer is on said inner side of said pad.

31. The method of claim 29 wherein said second layer is on said outer side of said pad.

32. The method of claim 31 wherein said step of cutting said score lines comprises the step of:

cutting said plurality of score lines through said second layer of high-density foam.

33. The method of claim 28 wherein said score lines are cut to be substantially circular.

34. The method of claim 27 further comprising the step of:

affixing a spinal ridge to an outer side of said pad along said longitudinal axis.

35. The method of claim 31 further comprising the step of:

cutting through said spinal ridge to match said plurality of score lines in said pad.

36. The method of claim 32 wherein said spinal rigid comprises a high-density foam.

37. The method of claim 32 wherein said spinal rigid comprises plastic.

38. The method of claim 26 further comprising:

affixing a spine reinforcement member made of rigid material to said pad along said longitudinal axis.

39. The method of claim 38 wherein said step of affixing said spinal reinforcement member comprises the steps of:

defining a groove cut along said longitudinal axis in a top side of said spine; and inserting an attachment member on a bottom side of said spine reinforcement member into said groove wherein said attachment member is press fit into said groove.

40. The method of claim 38 further comprises the step of:

defining a plurality of segments in said spine reinforcement member wherein each of said plurality of segments is shaped to correspond to an underlying segment of said spine defined by said plurality of score lines.

41. The method of claim 40 wherein said plurality of segments comprise a first plurality of substantially circular segments and a second plurality of segments having a first and a second sides having concave curvatures that are formed to receive adjacent ones of said first plurality of substantially circular members.

42. The method of claim 39 wherein said attachment member has a cross-member having a plurality of edges and said groove has a first lip along a first side wall of said groove and a second lip along a second side wall of said groove, and said step of inserting comprises inserting said edges behind said lips.

43. The method of claim 26 wherein said step of cutting said plurality of score lines comprises the step of:

defining a plurality of circular cuts into said pad between mated pairs of said first and said second pluralities of wings.

44. The method of claim 26 and further including inserting said pad into a pocket on a dorsal side of a garment.

45. The method of claim 44 wherein an inner side of said pad is proximate an outer layer of said garment and said outer side is proximate inner side of an outer layer of said pocket.

46. The method of claim 44 further comprising the step of:

affixing said pad to an inner side of said pocket in said garment.

47. The method of claim 44 further comprising the step of:

removing said pad from said pocket.

48. The method of claim 26 further comprising the step of:

forming an s-shaped curvature of said pad to configure to the spine of a user.

49. The method of claim 26 further comprising the step of:

affixing a top member to the top end of said pad wherein said top member has an upper contoured side.

50. The method of claim 49 wherein said upper contour side is formed to allow movement of the neck of said user.

51. The method of claim 50 wherein said top member has bottom edges of said top member that are slanted outward from said longitudinal axis toward said top side.

52. The method of claim 26 further comprising the step of:

affixing a bottom member to a bottom side of said pad wherein said bottom member has a bottom side contoured to form to the lumbar region of a user.

53. The method of claim 52 wherein said bottom side of said bottom member has a distal edge and extends outward and upward from said longitudinal axis to said edge.

* * * * *